United States Patent [19]

Glasgow

[11] 4,170,181

[45] Oct. 9, 1979

[54] TABLE SKIRTING AND DOUBLE-GRIP CLIP

[76] Inventor: Robert L. Glasgow, Rte. 1, Box 1100, Porter, Tex. 77365

[21] Appl. No.: 745,480

[22] Filed: Nov. 26, 1976

[51] Int. Cl.[2] ..... A47B 9/00

[52] U.S. Cl. ..... 108/50; 24/81 T

[58] Field of Search ..... 24/3 J, 3 M, 44, 49 C, 24/73 B, 73 BP, 73 MF, 73 SH, 81 R, 81 B, 81 BM, 81 DM, 81 FT, 150 R, 150 P, 152; 108/50; 5/333; 312/3; 211/180; 160/333

[56] References Cited

U.S. PATENT DOCUMENTS

| | | | |
|---|---|---|---|
| 942,366 | 12/1909 | Deeter | 24/3 J |
| 1,544,016 | 6/1925 | Lyman | 24/81 T |
| 1,899,795 | 2/1933 | Davis et al. | 24/3 J |
| 2,494,874 | 1/1950 | Mc D. Hess | 160/330 |
| 2,545,599 | 3/1951 | Bartlett | 24/81 DM |
| 2,614,305 | 10/1952 | Yeardley | 24/3 J |
| 3,959,854 | 1/1976 | Lewis | 5/333 |

FOREIGN PATENT DOCUMENTS

| | | | |
|---|---|---|---|
| 584927 | 9/1933 | Fed. Rep. of Germany | 160/330 |
| 9147 | of 1897 | United Kingdom | 5/333 |

*Primary Examiner*—Doris L. Troutman

*Attorney, Agent, or Firm*—Clarence A. O'Brien; Harvey B. Jacobson

[57] ABSTRACT

A table skirting system having a skirt in the form of a substantially rectangular piece of material attachable to a tabletop either by a double-grip clip according to the invention, or by a pin or pins engaging a cloth arranged covering the top of the table. The clip is provided with a bifurcated section received in separate side-by-side pockets provided in the skirt, while the head of the pin or pins is concealed in an upwardly opening seam formed along the top edge of the skirt.

3 Claims, 6 Drawing Figures

TABLE SKIRTING AND DOUBLE-GRIP CLIP

BACKGROUND OF THE INVENTION

1. Field of the Invention

This invention relates generally to the attachment of table skirting to a table, and particularly to a table skirting system which permits skirting to be attached to tables having tops of various sizes and configurations.

2. Description of the Prior Art

A problem encountered by schools, churches, fraternal orders, and other groups which maintain multi-purpose halls is the matter of occasionally using the folding tables generally found in conjunction with such halls for formal purposes, such as banquets, and the like. The usual approach is to cover the tables with a tablecloth, and attach decorative skirting to the tablecloth around the periphery of the top of the table so as to generally conceal the legs of the table and therefore enhance the appearance of the table. The skirting itself is generally custommade for a customer to correspond to the specific size of the tables used in a given hall.

The skirting presently available to the public provides only one method of attachment. Usually, this attachment is achieved by a band of tape being sewn onto the skirt to form a base for receiving pins which pin the skirting to the tablecloth. While it is desirable to use a clip which will attach the skirting directly to the tabletop, the use of clips has been severely limited due to the fact that many tabletops have, for example, very sharp beveled edges and, therefore, will not receive a clip. For this reason, most of the skirting systems manufactured in the past have relied upon the use of pins or pieces of material that adhere to one another for attaching the skirting directly to the tablecloth and not to the tabletop itself.

Numerous clips have been proposed for various purposes. An example of these clips can be found in U.S. Pat. No. 2,685,720, issued Aug. 10, 1954, to H. D. Petri.

SUMMARY OF THE INVENTION

It is an object of the present invention to provide a multi-purpose table skirting system to suit the needs of varying purchasers.

It is another object of the present invention to provide a table skirting system in which the skirting can be selectively attached either to a tabletop or to a tablecloth arranged on the tabletop.

These and other objects are achieved according to the present invention by providing a table skirting system having: a skirt in the form of a substantially rectangular piece of material; and a connector arrangement partly formed by the skirt itself for permitting attachment of the skirt to a table.

The connector arrangement includes a clip and at least one pin, with the clip being engageable both with a tabletop and the skirt for attaching the skirt to the tabletop, and the pin engageable with a cloth arranged over the tabletop and with the skirt for attaching the skirt to the table.

For those instances when the skirt is attached to the tablecloth and not clipped to the tabletop, the skirting is provided with a seam arrangeable running parallel to the plane of the tabletop and opening upwardly. The pin or pins used to attach the skirting each include a longitudinal shank having a pair of ends and terminating in a point at one of the ends and a head at the other of the ends. The pin will be inserted through the seam formed in the upper portion of the skirt so that the head of the pin will be concealed in the seam and not apparent except by close examination.

A clip according to the present invention comprises a substantially U-shaped element having a pair of codirectionally extending legs and a web joining the legs. One of the legs is shorter than the other of the legs and terminates in an extension folded back toward the other of the legs and terminating in a recess forming a bifurcated section of the clip which includes two codirectional fingers. These fingers are received in pockets formed by a facing on the rear surface of the pleat and separated by the crease of a pleat formed in the skirt so as to extend substantially at a right angle with respect to the plane of the tabletop.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
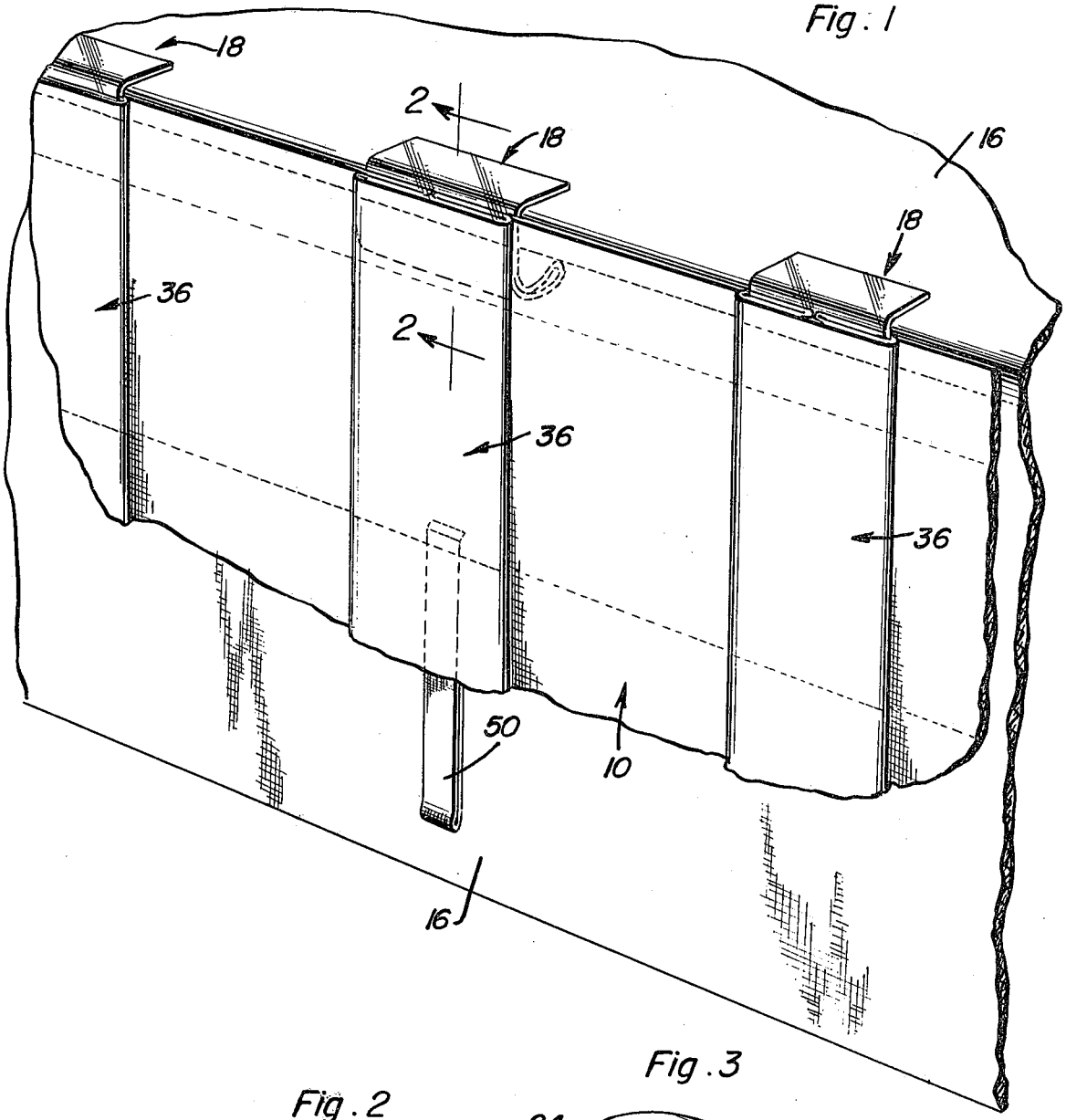
FIG. 1 is a fragmentary, perspective view, partly in section, showing a skirting system according to the present invention with clips being employed for attaching the skirt directly to the top of an associated table.
Figure 2:
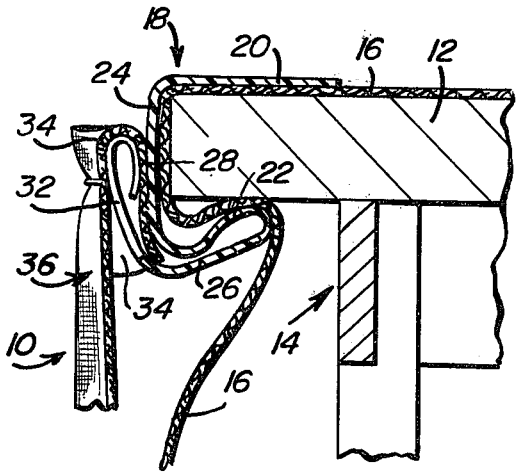
FIG. 2 is an enlarged, fragmentary, sectional view taken generally along the line 2—2 of FIG. 1, but with part of the skirt shown in full lines.
Figure 3:
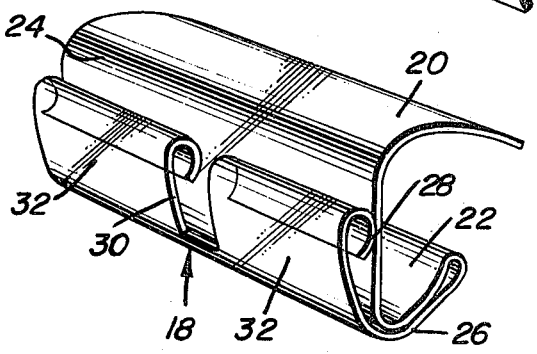
FIG. 3 is a perspective view showing a clip for use with the table skirting system according to the present invention.
Figure 4:
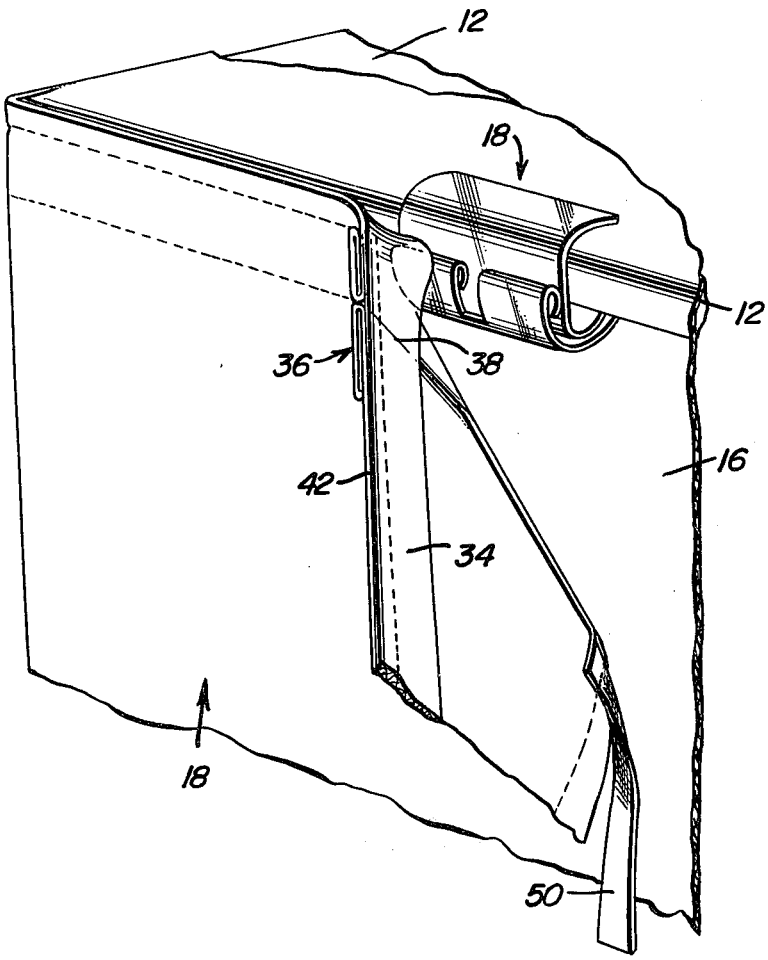
FIG. 4 is a fragmentary, perspective view, partly in section, similar to FIG. 1, but showing the skirt partially removed from one of the clips attaching the skirt to the tabletop.

Referring now more particularly to FIGS. 1 through 4 of the drawings, the table skirting system according to the present invention includes a skirt 10 in the form of a substantially rectangular piece of material. It will be understood that the length of skirt 10 will vary, and that the ends of the material forming skirt 10 can be sewn together to form a continuous length of material as desired and indicated for a particular situation. Skirt 10 is attached to the top 12 of a table 14 itself of conventional construction and, therefore, not described in detail herein. A tablecloth 16 is arranged over the upper surface of top 12 of table 14, and is retained on table 14 together with skirt 10 as by a plurality of clips 18.

Each of the clips 18 comprising a substantially U-shaped element having a pair of codirectionally extending legs 20 and 22 connected together by a web 24. It will be noted that the clip 18 can be stressed so that the legs 20 and 22 tend to converge toward one another in order to cause the clip 18 to engage an associated tabletop 12, and the like, with a predetermined force. Leg 22 is shorter than leg 20, and terminates in an extension 26 folded back toward leg 22 and itself terminating in a lip 28. Adjacent the terminal end of extension 26 and extending into the lip 28 is a recess 30 which forms a bifurcated section of clip 18 including two codirectional fingers 32.

Skirt 10 is provided with a facing 34 along the surface of the skirt 10 which is to face the tablecloth 16, and with a plurality of box pleats 36 uniformly spaced along the longitudinal extent of skirt 10. Each pleat 36 forms a crease 38 in facing 34 which in turn divides the facing 34 into a plurality of pockets. The fingers 32 are removably received in these pockets and, by means of the recess 30, is preferably arranged straddling an associated crease 38 so as to prevent movement of skirt 10 relative to clip 18 longitudinally of the extent of the skirt 10.

Figure 6:
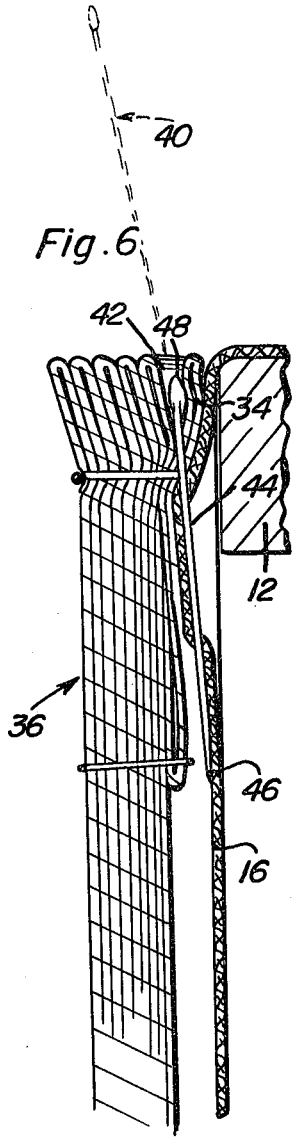
FIG. 6 is an enlarged, fragmentary, sectional view taken generally along the line 6—6 of FIG. 5.
Figure 5:
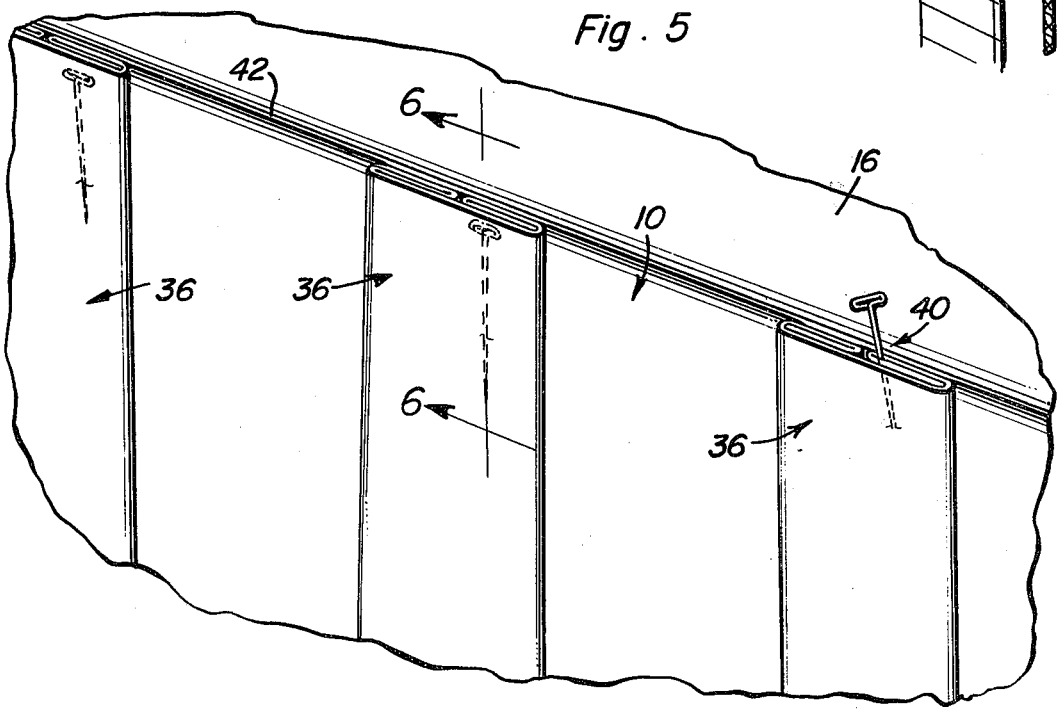
FIG. 5 is a fragmentary, perspective view, similar to FIG. 1, but showing the skirt attached by means of suitable pins to a tablecloth covering the associated tabletop.

As can be appreciated from the above description and from FIGS. 1 through 4, the use of clips 18 will securely attach skirt 10 to a top 12 of a table 14. If the top 12 has a rim extending thereabout, or is provided with an exaggerated beveled edge, neither of which is shown, which prevents clip 18 from securely gripping the periphery of tabletop 12, it is necessary to attach skirt 10 directly to the tablecloth 16 in a manner to be described with reference to FIGS. 5 and 6 of the drawings.

The connector arrangement also includes at least one pin 40 and preferably a plurality of such pins spaced along the longitudinal extent of skirt 10 in a manner similar to the arrangement of clips 18. Arranged running along the edge of skirt 10 which is to be disposed substantially parallel to the plane of tabletop 12 and immediately adjacent thereto is an upwardly opening seam 42 forming a fold in the fabric. Each pin 40 includes a shank 44 having a pair of ends, one of which terminates in a point 46 and the other of which has a head 48 affixed to shank 44 thereat. The point 46 of a pin 40 is inserted into skirt 10 within seam 42 so that when the pin 40 is completely inserted into skirt 10 the head 48 of the pin 40 will be concealed within the fold formed by seam 42.

A plurality of straps 50 are sewn to the rear surface of skirt 10 in order to facilitate storage of skirt 10 when same in not being used. More specifically, the loops formed by the straps 50 can be arranged over respective arms of a suitable hanger (not shown), with the skirt 10 being wound in a circular motion for compact storage.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A table skirting system, comprising, in combination:

(a) a skirt arrangeable along a peripheral portion of a top of a table with which the skirt is to be associated;

(b) connector means for mounting the skirt on the table, the connector means including a clip and at least one pin, with the clip being engageable with the top of the table and with the skirt for attaching the skirt to the top of the table, and the pin being engageable with a cloth arranged covering the top of the table and with the skirt for mounting the skirt on the table, the skirt being provided with a pleat and with a facing attached to the skirt adjacent an edge thereof arrangeable immediately adjacent the top of the associated table, the pleat forming a crease dividing the facing into a plurality of pockets, the clip comprising a substantially U-shaped element having a pair of codirectionally extending legs and a web joining the legs, one of the legs being shorter than the other of the legs and terminating in an extension folded back toward and extended beyond the one of the legs to a terminal end disposed adjacent to the web of the U-shaped element and terminating in a recess forming a bifurcated section of the clip including two codirectional fingers, the pockets partly forming the connector means and being arranged for removably receiving the fingers of the bifurcated section of the clip.

2. A supporting clip for mounting a table skirt on the edge of a table top in which the skirt includes a pair of adjacent downwardly opening pockets along the inner surface of the top edge with the pockets being separated by a vertical seam, said clip comprising a generally U-shaped member constructed of material adapted to grip the edge of the table top when placed thereon, said clip including a pair of spaced legs interconnected by a web with the legs normally converging away from the web and being stressed apart when the clip is mounted on the table top edge whereby the legs grip the table top, the leg of the clip adapted to grip the undersurface of the table top terminating in a reversely folded extension extending to a terminal edge alongside the outer surface of the web and cooperating therewith to define an upwardly opening clamping area, the portion of the extension defining the clamping area including a notch therein extending to the terminal edge to form adjacent terminal edges and adapted to receive the vertical seam when the adjacent terminal edges of the extension are received in the pockets and the inner portions of the pockets are clamped between the terminal edges of the extension and the web.

3. The clip as defined in claim 2 wherein said terminal edges of the extension are folded inwardly to present a convex gripping surface toward the web.

* * * * *